US005267812A

United States Patent [19]

Suzuki et al.

[11] Patent Number: 5,267,812

[45] Date of Patent: Dec. 7, 1993

[54] UPWELLING-GENERATING STRUCTURE

[75] Inventors: Tatsuo Suzuki, Hachioji; Koichi Taniguchi, Yokohama; Yoichi Honda; Eiichi Kudou, both of Tokyo, all of Japan

[73] Assignee: Hazama Corporation, Tokyo, Japan

[21] Appl. No.: 857,842

[22] Filed: Mar. 26, 1992

[30] Foreign Application Priority Data

Mar. 30, 1991 [JP] Japan ..... 3-067455
Oct. 31, 1991 [JP] Japan ..... 3-286491

[51] Int. Cl.[5] ..... E02B 1/00; E02B 3/06

[52] U.S. Cl. ..... 405/52; 405/15; 405/25

[58] Field of Search ..... 405/15, 21, 25, 29, 405/30, 34, 35, 79, 52

[56] References Cited

U.S. PATENT DOCUMENTS

| | | | |
|---|---|---|---|
| 2,069,715 | 2/1937 | Arpin | 405/25 |
| 3,953,976 | 5/1976 | Morren et al. | 405/21 |
| 4,341,489 | 7/1982 | Karnas | 405/35 |

FOREIGN PATENT DOCUMENTS

| | | | |
|---|---|---|---|
| 228336 | 5/1959 | Australia | 405/25 |
| 56469 | 11/1912 | Austria | 405/25 |
| 178510 | 4/1986 | European Pat. Off. | 405/25 |
| 130613 | 8/1982 | Japan | 405/29 |
| 151712 | 9/1982 | Japan | 405/25 |

*Primary Examiner*—David H. Corbin
*Attorney, Agent, or Firm*—Darby & Darby

[57] ABSTRACT

An upwelling-generating structure is a mound shape structure to be installed on the ground of seabed for generating an upwelling flow. The upwelling-generating structure consists of a summit across a tidal flow, and a gentle slope running from the summit to the seabed.

6 Claims, 12 Drawing Sheets

UPWELLING-GENERATING STRUCTURE

BACKGROUND OF THE INVENTION

The present invention relates to an upwelling-generating structure, and more particularly to a mound-shaped upwelling-generating structure set on the seabed. The commonly called upwelling that flows from a deep sea zone to a surface sea zone and that is low in temperature and high in specific gravity thrusts upward deep sea water liable to stagnate, thus developing the exchange of the sea water between the deep zone and the surface zone.

The upwelling also thrusts upward abundant resources of nutrient salts such as phosphates and nitrates in the deep zone of the sea water to the upper zone where the sunlight can be reached, thus developing the assimilation of solar photosynthesis and breeding of plankton in the sea water, while at the same time the difference in water pressure and temperature between the deep zone and the surface zone that thrusts upward the cold water in the deep zone to the surface zone enriches the amount of dissolved oxygen, thereby generating an inhabitable environment for fish.

Accordingly, if it is possible to make use of a horizontal flow of water such as ocean current or tidal current in order to generate vertical upwelling, it is very worth of trying to realize, and in fact many different types of structures have been developed for generating an upwelling flow from a horizontal flow.

As an example of prior art structures, Japanese Laid-open Utility Model Application No. 27482/1987 discloses a block structure 150 for artificial reef FIG. 18). As shown in FIGS. 18 and 19, a shielding plate 151 is installed perpendicularly to a tidal current A. According to this invention, the tidal current that collides with the shielding plate 151 rides across the shielding plate 151, while at the same time the tidal current generates a negative pressure area behind the shielding plate 151 where tidal currents A" that flows down along side plates 152 are drawn in. The tidal currents A" thus drawn in from both sides collide with each other to generate whirlpools, thereby causing the tidal current A' that rides across the shielding plate 151 to be oriented upward so that as a whole a large upwelling current is generated.

Another example of prior art structures, as is shown in FIG. 21, is a vertical V-shape structure 160 to form spiral streams 162 at both edges 161 thereof and the spiral streams 162 thus formed join together to generate horseshoe whirlpools 163 downstream. These horseshoe whirlpools 163 are more intensified by a tidal current B' that rides across plates 164, and after some of them join together in a peeling zone behind the plates 164, they flow downstream. In such downflow process, since these horseshoe whirlpools 163 have an upward self-induced velocity, heads of these horseshoe whirlpools ascend and finally all of these whirlpools as a whole ascend nearly vertically. Further, when such state of these horseshoe whirlpools is reached, the direction of the self-induced velocity is reversed backward so that a difference is velocity is caused between these horseshoe whirlpools and their surrounding flows, and this velocity difference causes heads of the horseshoe whirlpools to give upward lift, thus ascending more and more.

However, there is a problem that according to such prior art structures, since the tidal current A, as shown in FIG. 18, collides nearly perpendicularly with the shielding plate 151 at the artificial reef block 150, as shown in FIG. 20, a reverse current zone 154 grows which occurs in the upstream side of the shielding plate 151, thus making it impossible to change a horizontal flow efficiently to a vertical flow.

There is another problem that the V-shape structure 160 shown in FIG. 21 can create high upwelling only for one-directional flow moving toward a V-shape concave opening 165. To cope with a reciprocating stream that is caused by tidal ebb and flow, as an example, even the use of a W-shape or corrugated structure, as is shown in FIG. 22, does not create the spiral stream that causes the upwelling at both edges 168 of opening 167, thus being unable to expect considerable upwelling.

There is a further problem that since a vertical structure such as artificial reef block 150 or V-shape structure 160 has a large single body of structure, it is difficult to draw the structure into a deep seabed to install and further to recover the structure that turns down after installed.

SUMMARY OF THE INVENTION

It is an object of the invention to provide an upwelling-generating structure that can reduce a reverse current zone at the upstream side of the structure and to change a horizontal flow efficiently to a vertical flow.

Another object of the invention is to provide an upwelling-generating structure capable of generating a large upwelling flow even when the structure is formed to have a corrugated shape so that it can respond to a reciprocating stream.

A further object of the invention is to provide an upwelling-generating structure that can be installed easily based on a required scale on a seabed and that can be repaired easily.

A still further object of the invention is to provide a mound shape upwelling-generating structure that can generate an upwelling flow efficiently using a less amount of material.

Accordingly, in order to achieve the aforementioned objects, the invention provides an upwelling-generating structure of a mound shape to be installed on the seabed for generating an upwelling flow, comprising a summit of the structure installed across a tidal flow, and a gentle slope running from the summit to the seabed.

The invention also provides an upwelling-generating structure comprising a pair of substantially conic mound structures each having a slope running in a radial direction from a top to seabed, and a partition structure connecting one of the pair of the conic mound structures with the other, the partition structure being lower in height than the pair of the conic mound structures.

BRIEF DESCRIPTION OF THE DRAWINGS

FIG. 10 (*b*) is an explanatory side view of FIG. 10 (*a*).

FIG. 14 (*b*) is a schematic plan view of FIG. 14 (*a*).

PREFERRED EMBODIMENTS OF THE INVENTION

Referring to the attached drawings, some embodiments of the invention will be described in detail next.

Figure 1:
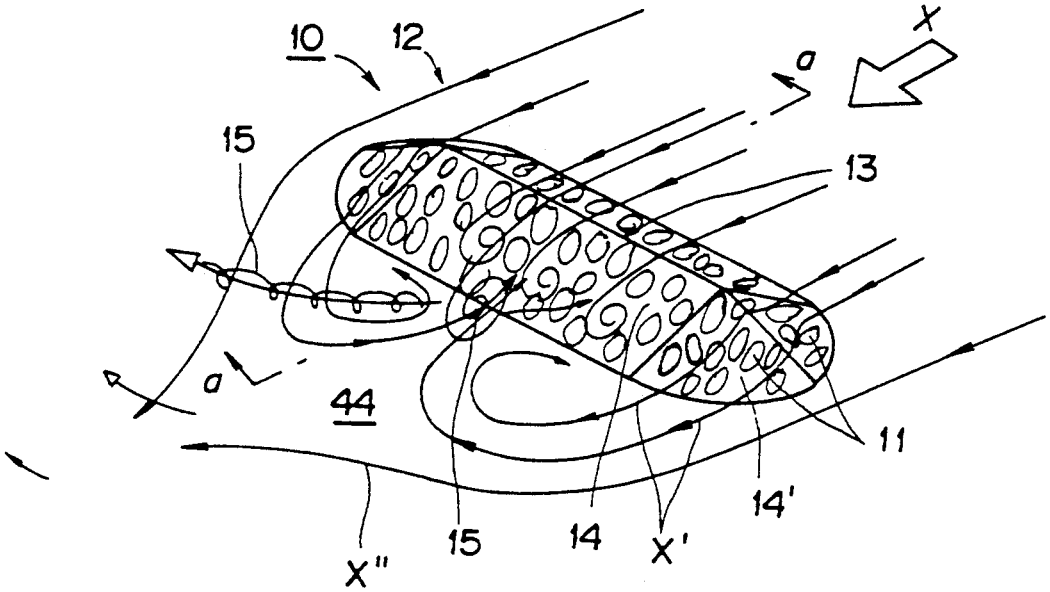
FIG. 1 is a schematic perspective view showing an embodiment of the upwelling-generating structure of the invention.

As FIG. 1 shows, an upwelling-generating structure 10 of the invention consists of a mound structure 12 built up by piling up a plurality of blocks 11 of about 10 *kg* ~ 100*t* on the seabed 44 so as to form a mound structure having a vertical triangular section with a height that is about 20% of the depth of water and a width that is about 3~4 times the height, and having a length that is about 4~20 times the height, and this structure 12 has slanting surfaces 14 and 14' gently slanting down to the seabed 44 from a linear summit 13 allocated in a direction across a tidal current X. Such slanting surfaces 14 and 14' are slanting at a degree of about 20°~45° relative to the horizontal surface. This mound structure 12 is built up by a method of sinking blocks 11 one by one from a laying boat to the seabed while accurately positioning each block or by a method of naturally falling blocks 11 from a bottom-hopper barge or the like by controlling dispersion of the falling blocks. Further, the mound structure 12, in case where its shape is destroyed by natural disaster or the like or if it is desired to change its scale or shape, can be easily mended and rebuilt by the aforementioned methods.

Figure 2:
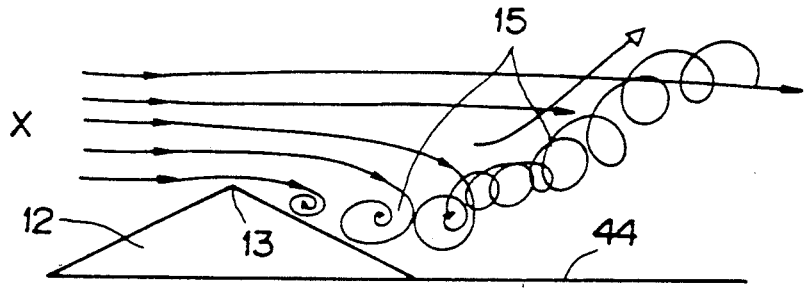
FIG. 2 is a sectional view of FIG. 1 along line a—a.
Figure 3:
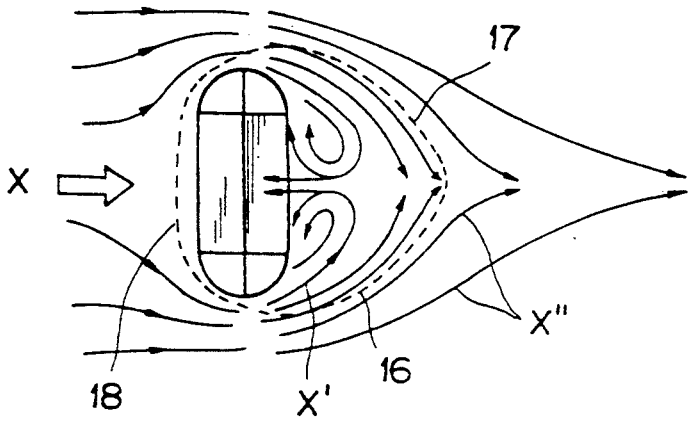
FIG. 3 is a plan view of the upwelling-generating structure of FIG. 1.
Figure 4:
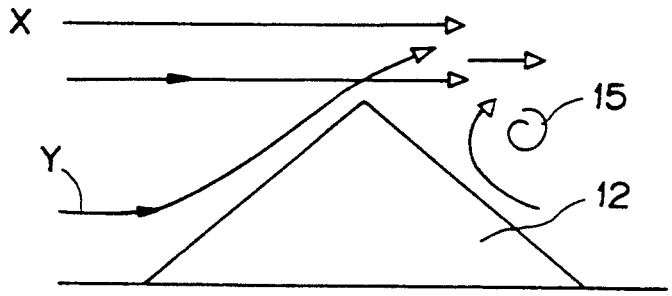
FIG. 4 is an explanatory view showing the movement of a flow that collides with the upwelling-generating structure of FIG. 1.

This upwelling-generating structure 10 acts toward the tidal current that passes through the structure as is described below. That is, the tidal current flows in the direction nearly perpendicularly to the linear summit 13 thereof, and the tidal current X passing over above the mound structure 12 with the aid of a negative pressure zone 17 (FIG. 3) occurring behind the upwelling structure 12 creates vertical whirlpools 15 and thrusts them upward, as is shown in FIG. 2. On the other hand, a tidal current X' passing over above the slanting surface 14' from both ends of the summit 13 changes its direction inward and creates horizontal whirlpools 16, thereby developing the aforementioned upwelling, as also shown in FIG. 3. Further, tidal currents X" passing both sides of mound structure 12 are drawn into the center of the stream by the action of the negative pressure zone 17 to collide with each other, and are drawn up by the whirlpools 15, thus being thrust upward. Furthermore, a flow Y that collides with the mound structure 12, as shown in FIG. 4, ascends along the slanting surface 14 and at the summit joins together with the horizontal tidal current X that passes over above the summit 13 to intensify the ascending stream, while on the contrary a reverse current zone 18 in the upstream side of the mound structure 12 is reduced (FIG. 3).

Figure 5:
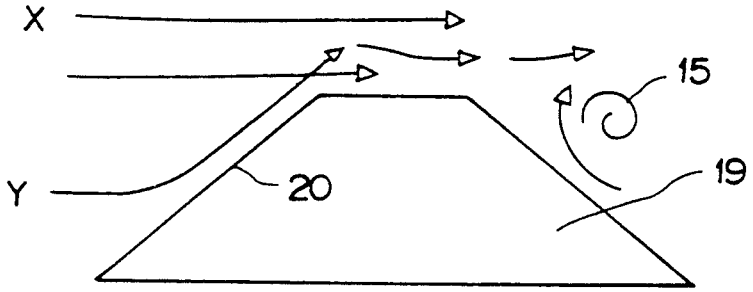
FIG. 5 is an explanatory view showing the movement of a flow that collides with a mound shape structure whose section is formed into a trapezoid.
Figure 6:
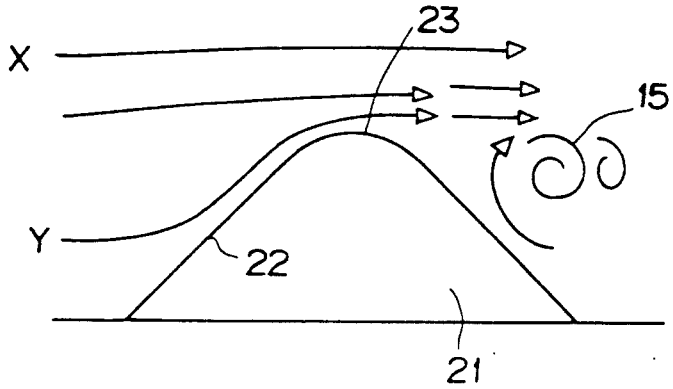
FIG. 6 is an explanatory view showing the movement of a flow that collides with a mound shape upwelling-generating structure whose section is formed into an arc.

FIGS. 5 and 6 show mound structures with vertical trapezoidal and arc sections, respectively. In a mound structure 19 in FIG. 5, as is similar to the triangular section shown in FIG. 4, since the flow Y that collides with a slanting surface 20 ascends along the slanting surface 20 and joins with the horizontal tidal current X at the summit, whirlpool 15, or upwelling flow, can be efficiently generated. In a mound structure 21 in FIG. 6, the flow Y that ascends along a slanting surface 22 changes its direction of flow to nearly horizontal at a summit 23, thus more intensifying the horizontal tidal current X.

Figure 7:
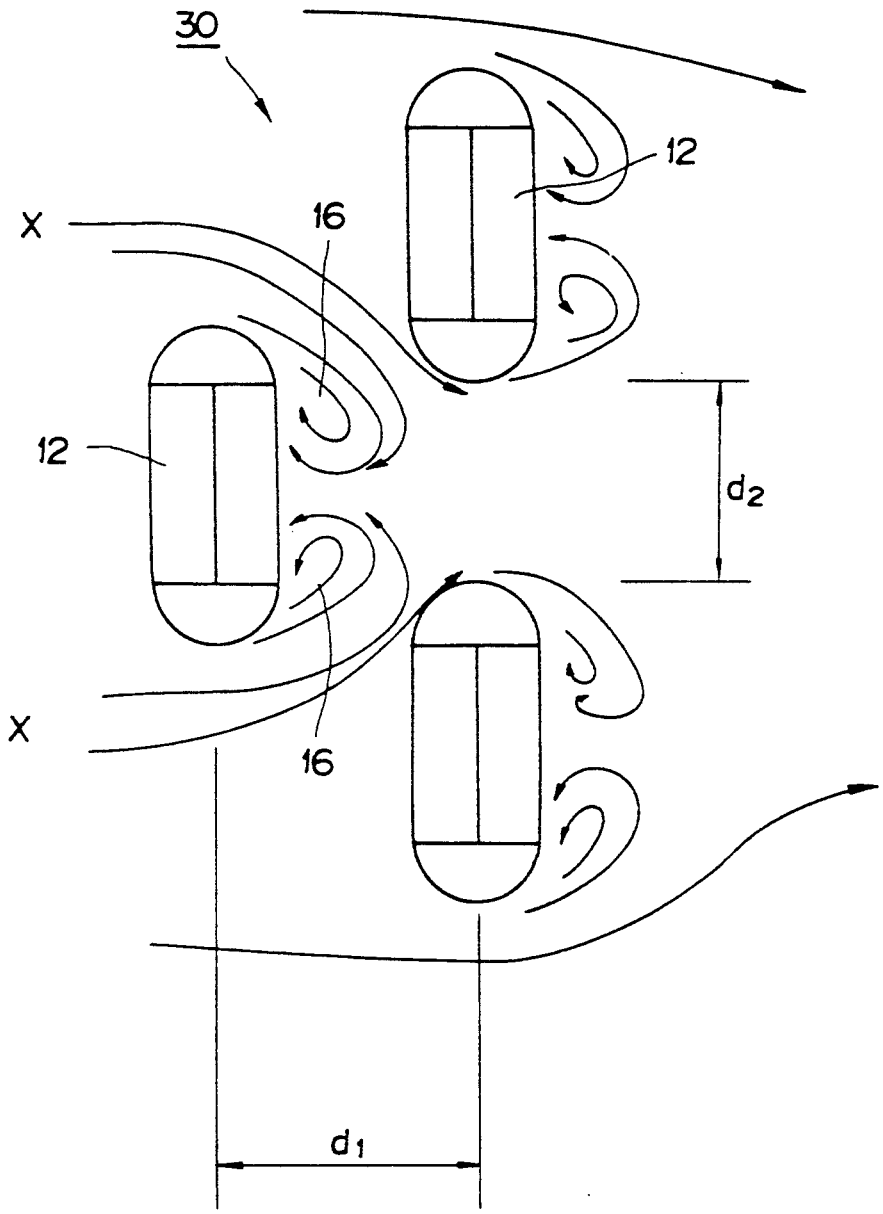
FIG. 7 is a schematic plan view of upwelling-generating structures where mound shape structures are lined up alternately on two lines.

In addition, the upwelling-generating structure 30 shown in FIG. 7 is arranged such that the mound structures 12 shown in FIG. 1 are laid on two lines having a distance d1 between centers of the structures 12 on the two lines, d1 being obtained by adding the width of the mound structure 12 to the half of the length of the mound structure 12, and with an interval d2 between two adjacent mound structures 12 on the same line at the downstream side with the interval d2 being a half of the length of the mound structure 12 so that the mound structures 12 at the downstream side partially shield the structure 12 at the upstream side. With this arrangement, an amount of rolling in of the tidal current X that changes its direction inward increases to intensify the horizontal whirlpool 16, thereby shortening an upwelling period to increase an amount of upwelling.

Figure 8:
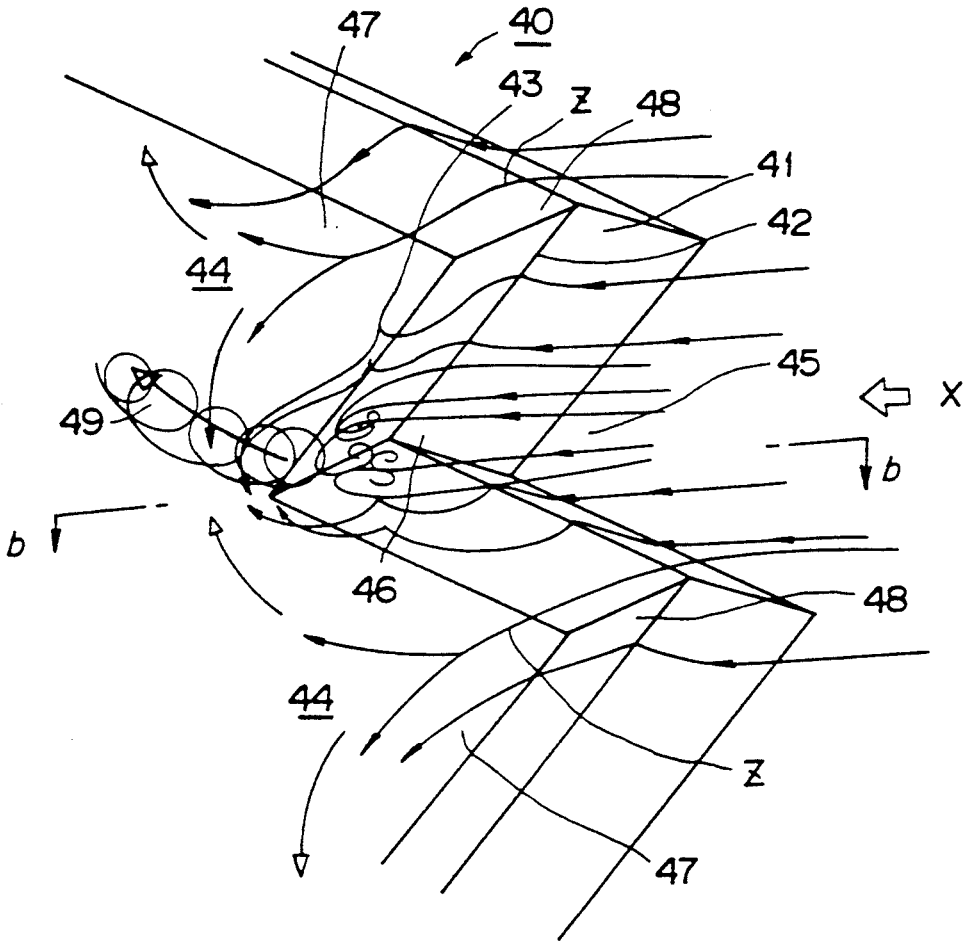
FIG. 8 is a schematic perspective view of a corrugated mound-shape upwelling-generating structure.
Figure 9:
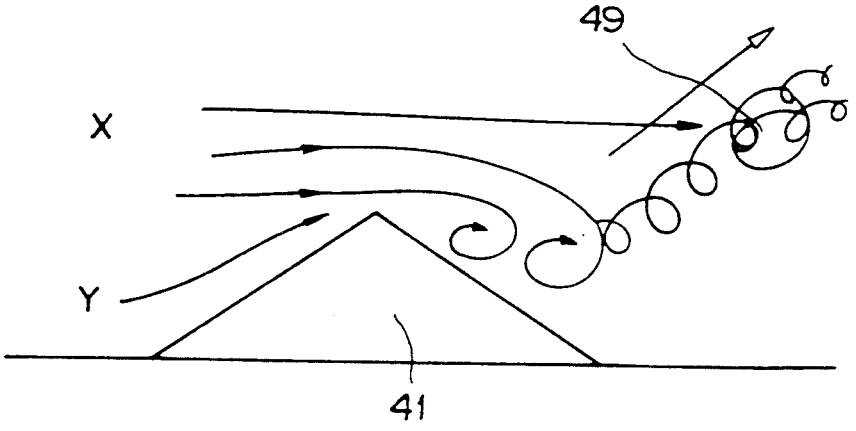
FIG. 9 is a sectional view of FIG. 8 along line b—b.

Furthermore, an upwelling-generating structure 40 shown in FIG. 8 is a mound structure 41 with a corrugated, or W-shape summit. In the upwelling-generating structure 40 thus made, spiral whirlpool 43 that causes upwelling occurs on a summit 42 in the neighborhood of a contact edge 46 of a V-shape concave section 45 that opens upstream, thereby generating large upwelling whirlpools 49, as shown in FIG. 9. In addition, a tidal current Z that rides across the summit 42 in the neighborhood of another contact edge 48 of a V-shape concave section 47 that opens downstream flows down and collides with the surface of the seabed 44, and at the same time the tidal current Z spreads out at both sides and flows in the downward section of the upwelling whirlpool 49 due to the spiral whirlpool 43 to enhance upwelling. Further, since in this upwelling-generating structure 40, at both corrugated sides the V-shape concave sections 45 and 47 open upstream and downstream, respectively, even when the direction of the flow that passes across the mound structure 41 changes, the structure can generate the upwelling whirlpool 49, or upwelling flow, without reducing the magnitude of the flow. In addition, as aforementioned, the sectional shape of the mound structure 41 may be a trapezoid or arc.

Since the upwelling-generating structure of the invention described so far is composed of a mound shape structure having the summit with a prescribed shape allocated across the tidal current and the gently slanting surfaces, the flow that collides with this mound structure ascends along the slanting surfaces and reduces the reverse current zone at the upstream side thereof, thus changing a horizontal flow efficiently to a vertical flow. Further, when mound structures are installed along at least two adjacent parallel lines perpendicularly to the direction of a tidal current that passes the lateral sides thereof alternating positions of mound structures installed on a line with those of mound structures on another adjacent line, an amount of rolling in behind the mound structures on a line at the upstream side increases, thus enhancing the upwelling effect of the structure. Furthermore, building a corrugated mound structure can generate large upwelling flows in response to individual directional flows of reciprocating stream. In addition, when blocks, rubble mounds, and so on are piled up in arbitrary shape and scale to build a mound structure, in case where the mound structure is broken or if it is desired to change the scale or shape of the structure, the structure can be easily repaired or rebuilt.

Next, an embodiment of a further improved upwelling-generating structure of FIG. 1 will be explained.

Figure 10A:
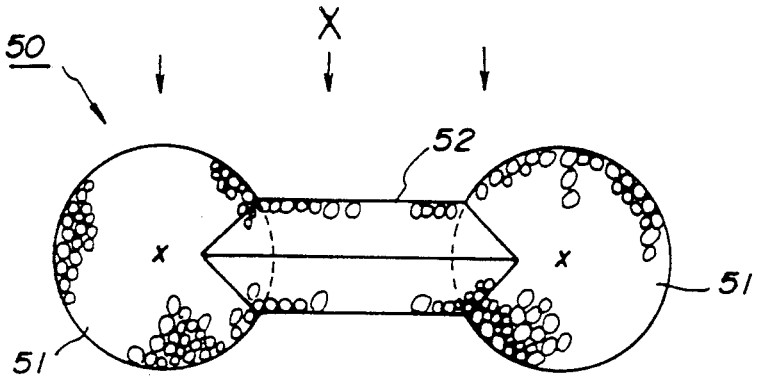
FIG. 10 (*a*) is an explanatory plan view of another embodiment of an upwelling-generating structure of the invention.
Figure 10B:
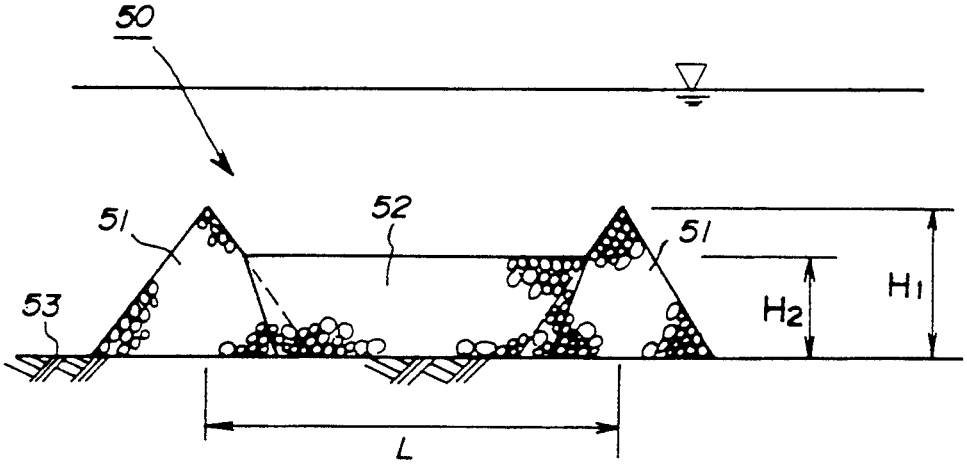

As is shown in FIGS. 10 (*a*) and 10 (*b*), an upwelling-generating structure 50 of the invention consists of a pair of conical mound structures 51 installed perpendicularly to the direction of flow X and a partition structure 52 installed therebetween. The mound structure 51 is built by piling up mound materials such as rubble mound, block, coal ash concrete, etc. on the ground 53 of the seabed. On the other hand, the partition structure 52, as is similar to the mound structure 51, is built by piling up the mound materials such as rubble mound, block, coal ash concrete, etc. and by connecting it at both ends to the pair of conic mound structures 51 having a vertical nearly triangular section, wherein a gently slanting surface runs from a summit to the ground 53 of seabed with a height H2 being about 0.5~0.9 times the height H1 of the conic mound structure 51.

In the upwelling-generating structure 50 having such configuration, an amount of the material for building the structure 50 can be markedly reduced in comparison with the mound structure 10 shown in FIG. 1. That is, in the upwelling-generating structure 50 of this embodiment of the invention, since the pair of conic mound structures 51 are connected by the partition structure 52 with a height lower than the conic mound structure 51, the volume of the structure 50 can be reduced in comparison with the mound structure 10 having nearly the same section over the entire length.

It is preferred to determine the height H1 of the pair of conic mound structures 51 to be 0.2~0.5 times the depth of water. If the height H1 of the conic mound structure is lower than 0.2 times the depth of water, since the upwelling whirlpool does not reach highly enough the upper zone when the flow velocity is low, while on the other hand the height H1 of the structure 50 greater than 0.5 times the depth of water can generate too sufficient upwelling to be uneconomical, thus being not preferred. It is preferred to determine the height H2 of the partition structure 52 to be in a range of 0.5~0.9 times the height H1 of the conic mound structure 51, as mentioned above. If the height H1 is less than 0.5 times, the upwelling-generating structure 50 is the same as the structure where conic mound structures are built independently, while the height H1 greater than 0.9 times makes this structure 50 not different in upwelling efficiency from the conventional ordinary mound structure, thus being not preferred. Still furthermore, it is preferred to determine the length L (distance) between the pair of conic mound structures to be 4~8 times the height H1 of the conic mound structure 51. The length L shorter than 4 times the height H1 degrades the reaching height of upwelling whirlpool, while the length greater than 8 times the height H1 satisfies the reaching height of upwelling whirlpool but degrades the upwelling efficiency per mound volume, thus being not preferred. Additionally, it is preferred to determine the slope angle of the conic mound structure 51 to be in a range of 45°~20°. The slope angle greater than 45° is actually difficulty built, and the slope angle gentler than 20° not only degrades the reaching height of upwelling whirlpool, but also increases the volume of material necessary to build the mound structures, thus being not preferred.

As described so far, the upwelling-generating structure of the invention consists of the pair of nearly conic mound structures 51 and the partition structure 52 lower in height than the nearly conic mound structure 51 for connecting the pair of nearly conic mound structures 51 and can generate upwelling flow more economically and efficiently in comparison with the mound structure 10 of FIG. 1.

Further, if the partition structure 52 is built with a vertical nearly triangular section such that a slope gently runs from the summit down to the surface of seabed, an upwelling-generating structure with a good upwelling-generating efficiency can be easily built using natural falling of the mound material in the sea.

Furthermore, the summit can be formed into linear, banded, curved shape, or the like. That is, the vertical sectional shape of the mound structure can be formed into a triangular, trapezoidal, arched, or other shape having gently slanting surfaces at both sides.

Still further, such mound structure may be monolithically formed using concrete, steel structure, or the like, while it may also be built by piling up blocks, rubble mounds, or the like in arbitrary shape and scale.

Although the partition structure may be installed by embedding both ends of steel plates formed into a trapezoid, for example, in the pair of nearly conic mound structures, it is preferred to build a mound structure with vertical nearly triangular sections where slanting surfaces run at gentle inclination from the summit lower than the top height of the mound structure down to the surface of the seabed.

Figure 11:
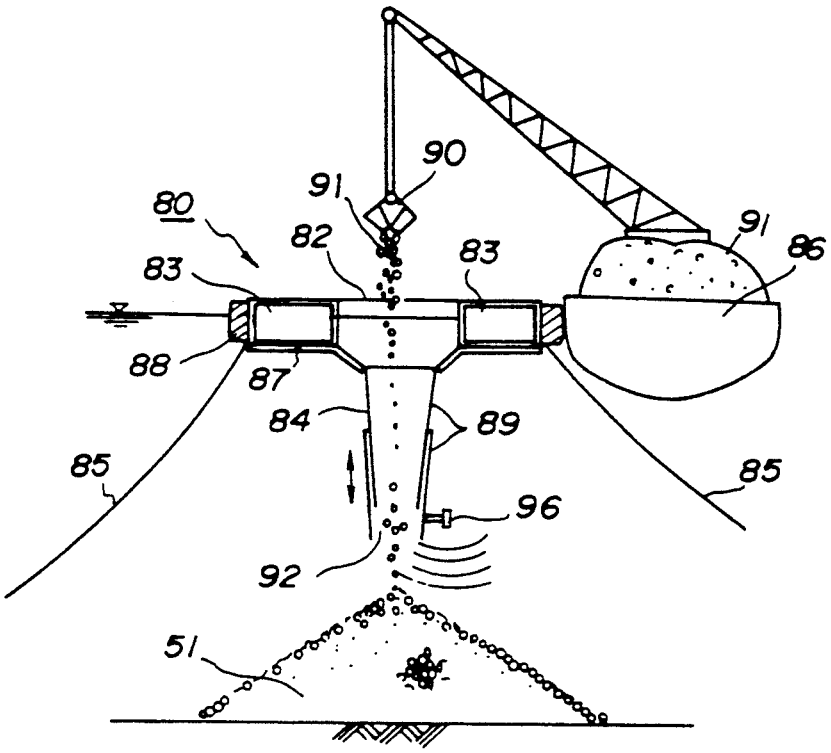
FIG. 11 is an explanatory view showing the first method of installing an upwelling-generating structure by piling up mound materials.

FIG. 11 shows a method of building the conic mound structures 51 of the upwelling-generating structure 50.

Floating facility 80 shown in FIG. 11 is towed by another boat or is navigated by itself if it is powered by navigation means to move to a sea area where for example the conic mound marine structures 51 are to be built, and is moored at a predetermined position by mooring ropes or the like.

The floating facility 80 consists of a floating body 83 functioning as a framework having a mound material charge opening 82 at the center thereof, a cylindrical body 84 that is tapered downward from the charge opening 82 and suspended into water and that is opened at the bottom, and mooring cables 85 attached to the floating body 83. Further, fenders 88 are attached to the surrounding of the floating body 83 to protect the floating body 83 and a boat from being damaged when a boat such as grab dredger is drawn up alongside the floating body 83. Furthermore, the bottom and the periphery of the charge opening 82 are reinforced using an iron plate 87. On the other hand, the cylindrical body 84 is composed of two overlapped, downward tapered cylindrical unit bodies 89 made of steel plate or steel bar fabricated into plate or net, with the upper unit cylindrical body 89 being fixed by welding to the bottom end of the charge opening 82, while the lower unit cylindrical body 89 is made to slide up and down along the upper unit cylindrical body 89, thereby expanding and contracting the cylindrical body 84. Such sliding of the lower unit cylindrical body 89 can be realized via a wire connected thereto as an example. In addition, the lower unit cylindrical body 89 is equipped with an ultrasonic probe 96 in the neighborhood of the bottom thereof, thereby controlling the building form of the mound marine structure 51 under construction.

The floating facility 80 moored at a predetermined position is loaded with mound materials 91 such as stone, coal ash concrete block, and so on by a bucket 90 from a grab dredger 86 lying alongside the floating facility 80 through the charge opening 82. The mound material 91 thus supplied falls without dispersion along a charge route that is determined by the cylindrical body 84 and reaches the bottom of the sea from the circular tip opening 92 of cylindrical body 84. That is, since the distance from the tip opening 92 to the seabed is short, the mound material 91 can reach a predetermined position accurately at the seabed. In addition, since it is not necessary to lower the bucket 90 of the grab dredger 86 as far as the seabed, the charge work can be carried out smoothly. Although this method uses cylindrical body 84 with the circular tip opening in order to build the conic mound marine structure 51, the mound marine structure having another arbitrary shape such as semicircular structure can be built by changing the shape of the tip opening 92 to a predetermined one. In addition, sequentially moving a mooring position of the floating facility 80 by positioning means and means of moving the floating facility 80 during, before, or after throwing the mound material into the sea or sequentially adjusting the length of the cylindrical body 84 can build a mound structure in a desired shape accurately. That is, as an example, when a cylindrical body with circular section is used to build the conic mound marine structure 51, adjusting the length of the cylindrical body 84 so that the tip opening 92 of the cylindrical body 84 can always position right above a predetermined mound position, stabilizes the position of the summit of the mound, thereby building the mound marine structure 51 so that the inclination of the slanting surface can come at a value close to a stable angle suitable for generating an upwelling flow.

Figure 12:
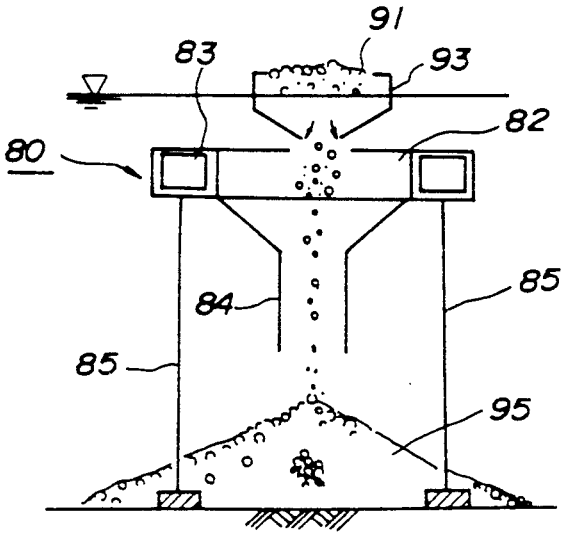
FIG. 12 is an explanatory view showing the second method of installing an upwelling-generating structure in a manner different from the first method shown in FIG. 11.

Next, there is another building method for mound structure as shown in FIG. 12. In this building method, the floating facility 80 is moored at a water depth such that a barge 93 can pass above the facility 80 by stretching mooring cables 85. In addition, the bottom-hopper barge 93 loaded with mount material 91 is moved to a position above the floating facility 80 and the bottom-hopper is opened to throw the mound material 91 directly into the charge opening 82 of the floating facility 80. According to this method, a large scale mound marine structure 95 demanding a large volume of mound material can be built quickly and accurately.

Figure 13:
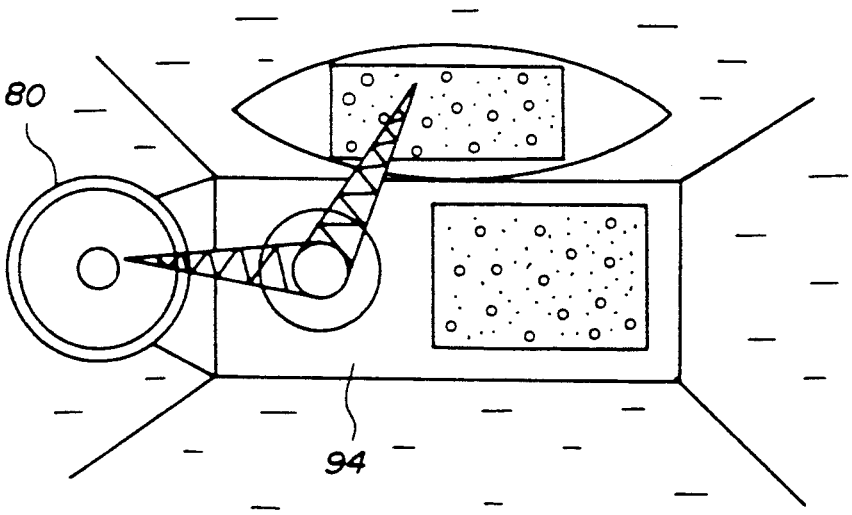
FIG. 13 is an explanatory view showing the third method of installing an upwelling-generating structure in a manner different from the first method shown in FIG. 11.

In order to moor the floating facility 80, it is not necessarily needed to use the mooring cables 85, and as an example, as shown in FIG. 13, the floating facility 80 may be moored by attaching it to a floating crane 94, or the like. Further, it is also possible to erect a jacket type structure or the like from the seabed to fix the floating facility 80.

Figure 14A:
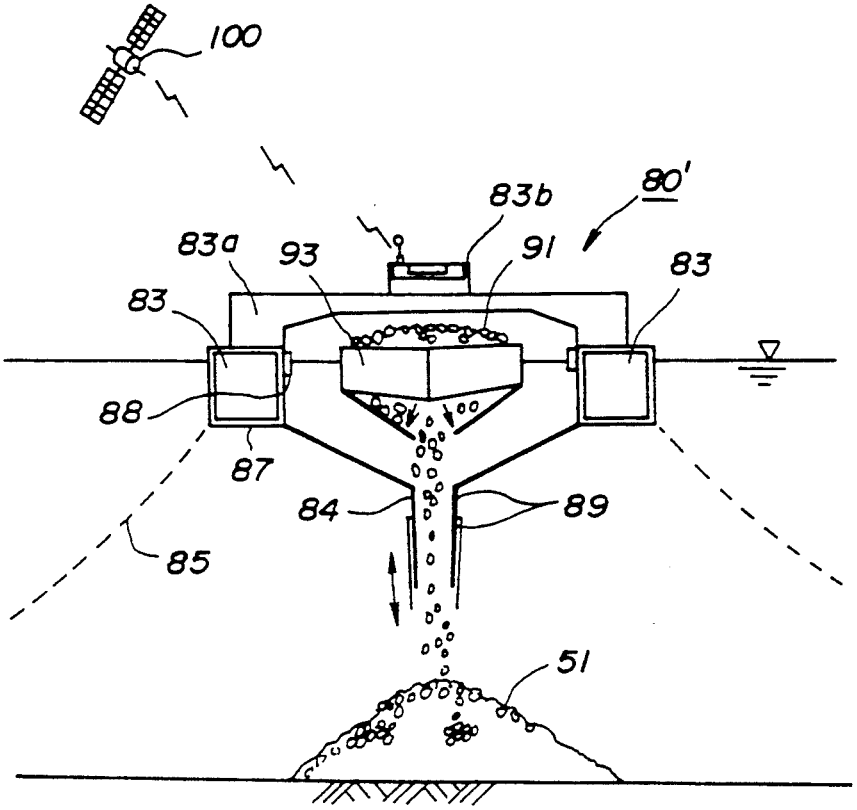
FIG. 14 (*a*) is an explanatory view showing the fourth method of installing an upwelling-generating structure in a manner different from the first method shown in FIG. 11.
Figure 14B:
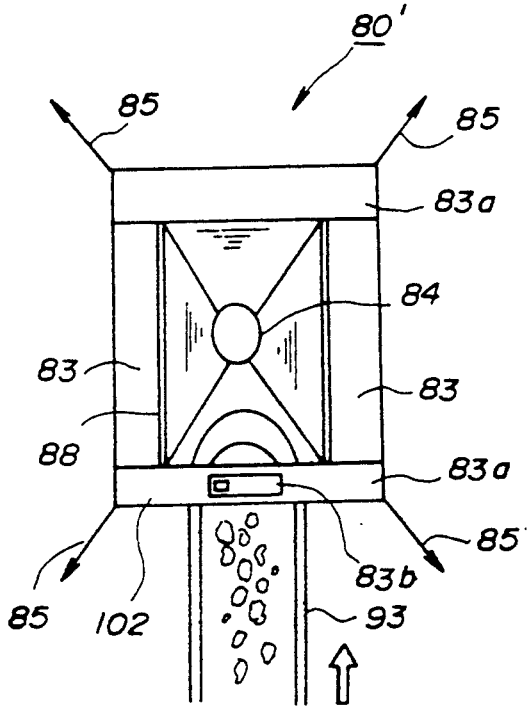

Still a further building method is shown in FIGS. 14(*a*) and 14(*b*). In addition, the same reference numbers as used for the configuration shown in FIGS. 11 and 12 are used for the same configuration as that of FIGS. 11 and 12, and the explanation of the reference numbers is omitted. According to this building method, a floating facility 80' is provided with bridges 83*a* that bridge both ends on the upper surface of each floating body 83. One side 102 of the bridges 83*a* has a control tower 83*b*. This control tower 83*b* receives a communication control signal via an artificial satellite 100, and the floating facility 80' is remotely operated, thereby moving the floating facility 80' to a sea area where the mound marine structure 51 is to be built. The floating facility 80' is moored at a predetermined position in the sea area stated above by mooring cables 85. Next, the barge 93 passes between the floating bodies 83 under the bridge 83*a* (FIG. 14(*b*)) and stops at the center of the floating facility 80'. After that, as is similar to the method of FIG. 12, the bottom hopper of the barge 93 is opened and mound material 91 naturally falls to the seabed through the cylindrical body 84 to build the mound marine structure 51.

As described, since the floating facility equipped with the charge opening for the mound material and a guide member such as the cylindrical body with the bottom tip that opens in a predetermined shape is moored at a predetermined position to throw the mound material by the bucket or the like via floating bodies, dispersion of the mound material to be thrown to the seabed can be prevented and besides the position of the floating facility is sequentially changed and the length of the guide member is adjusted so that a mound marine structure with a desired shape can be built accurately and quickly. Further, the floating facility is moored by stretching at a predetermined water depth and to the position above the floating facility the bottom-hopper barge is moved to throw the mound material directly therefrom, thereby building even a large scale mound structure quickly and accurately.

Next, referring to the embodiment of the efficiency of generating an upwelling flow by an upwelling-generating structure having the aforementioned configuration, will be described following a result of experiments in which the behavior of upwelling flows are observed by letting liquid dyestuff run from the upstream side of the structure to investigate the average height of the summit of upwelling whirlpool and the frequency of the occurrence of upwelling whirlpool.

Figure 15:
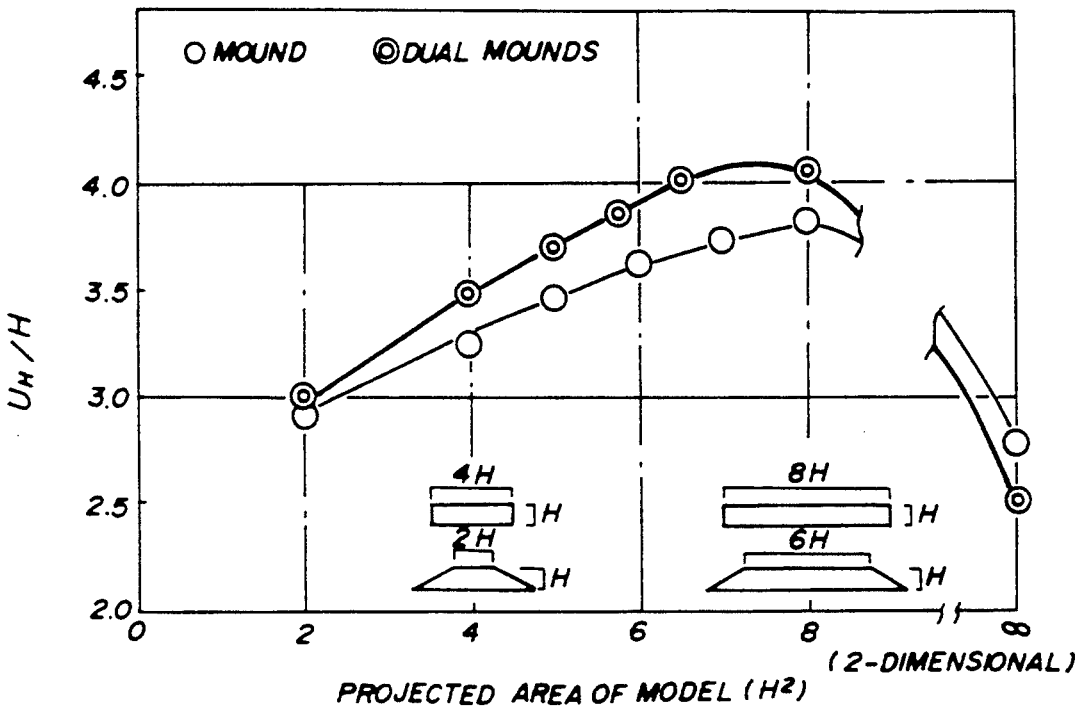
FIG. 15 is a chart of the variation of the ratio of height UH of upwelling whirlpool to height H of an upwelling-generating structure having various shapes when changing projected area of the upwelling-generating structure model.

FIG. 15 shows the variation of the ratio of height UH of upwelling whirlpool to height H of the structure when changing projected area $H^2$ in a single mound structure (◯) of FIG. 1 and a dual mound structure (◎) of FIG. 10. The projected area $H^2$ herein means sectional areas of the single mound and the dual mound structures in FIGS. 1 and 10, respectively.

Figure 16:
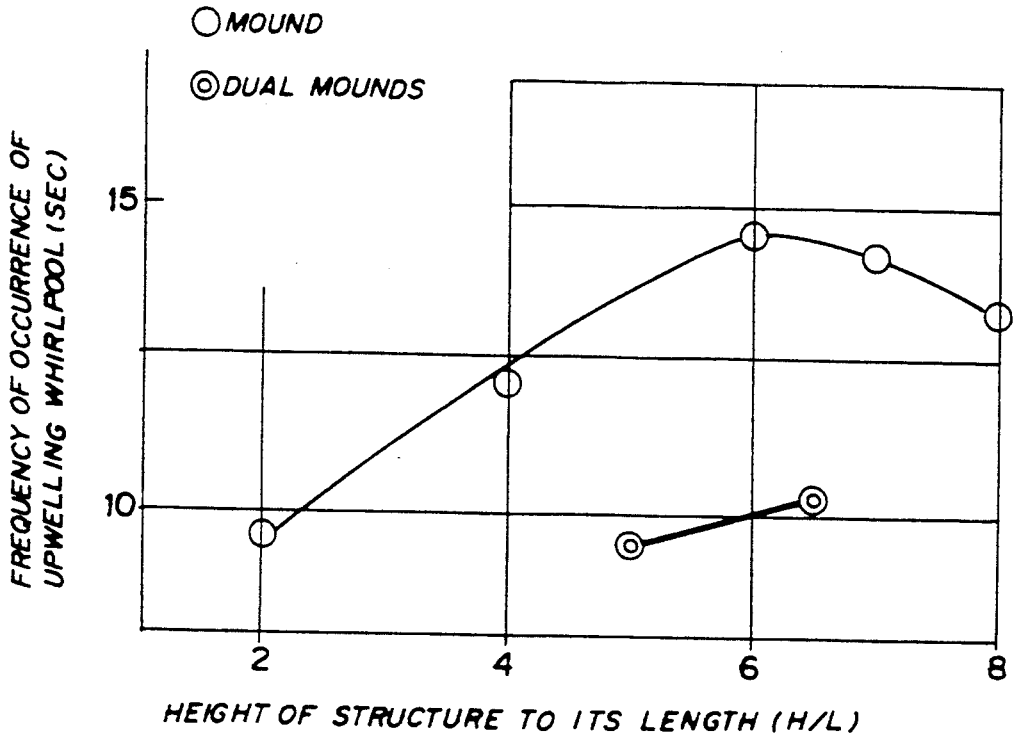
FIG. 16 is a chart of the variation of the frequency of the occurrence of whirlpool caused by an upwelling-generating structure having the same projected area when changing the ratio of height H to length L.
Figure 17:
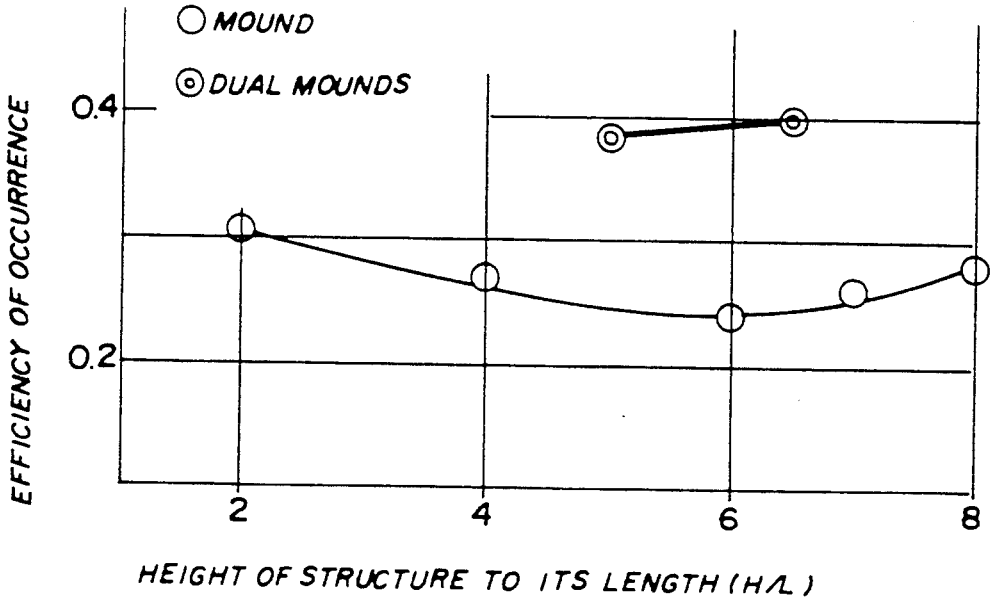
FIG. 17 is a chart of the variation of the efficiency of the occurrence of whirlpool caused by an upwelling-generating structure having the same projected area when changing the ratio of height H to length L.
Figure 18:
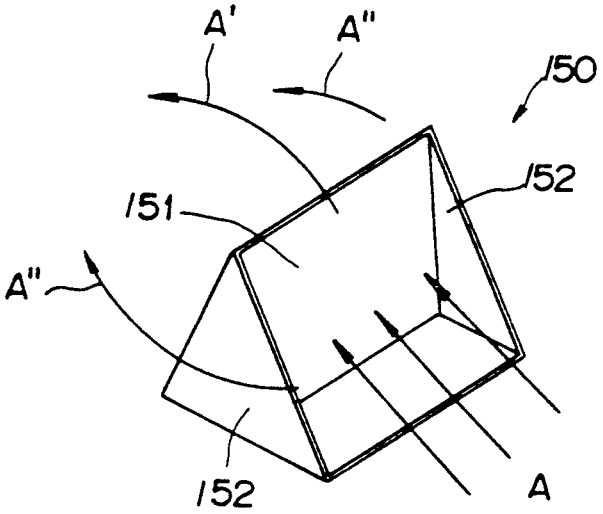
FIG. 18 (PRIOR ART)
FIG. 18 is a schematic perspective view showing an embodiment of the conventional upwelling-generating structure.
Figure 19:
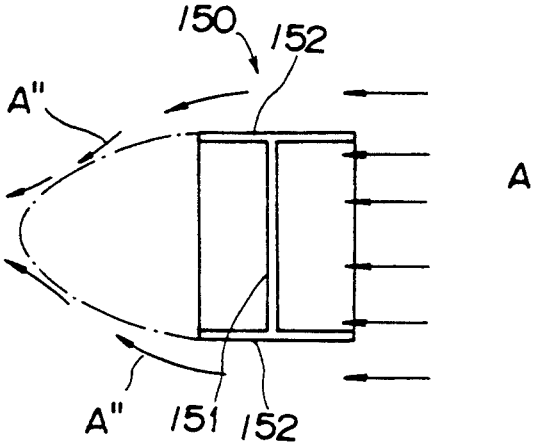
FIG. 19 (PRIOR ART)
FIG. 19 is a plan view of the upwelling-generating structure of FIG. 18.
Figure 20:
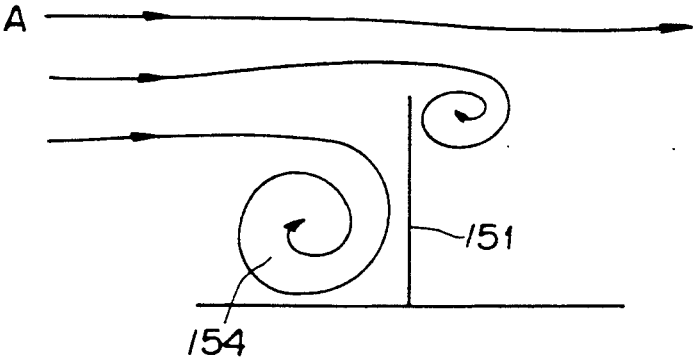
FIG. 20 (PRIOR ART)
FIG. 20 is an explanatory view showing the movement of a flow that collides with the upwelling-generating structure of FIG. 18.
Figure 21:
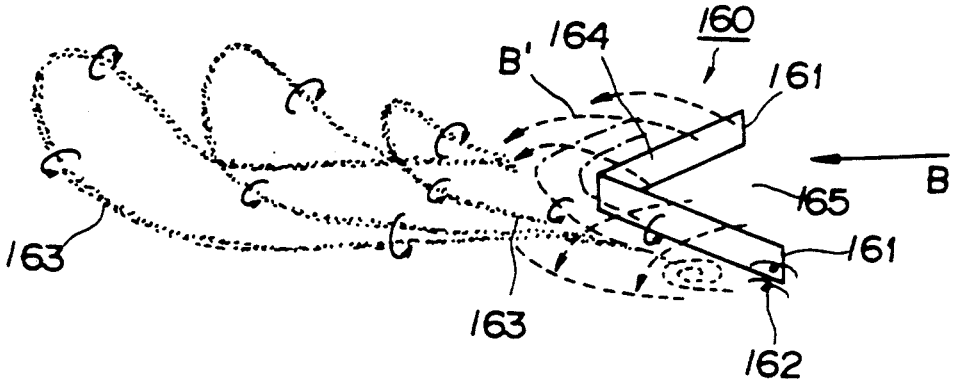
FIG. 21 (PRIOR ART)
FIG. 21 is a schematic perspective view showing another embodiment of the conventional upwelling-generating structure.
Figure 22:
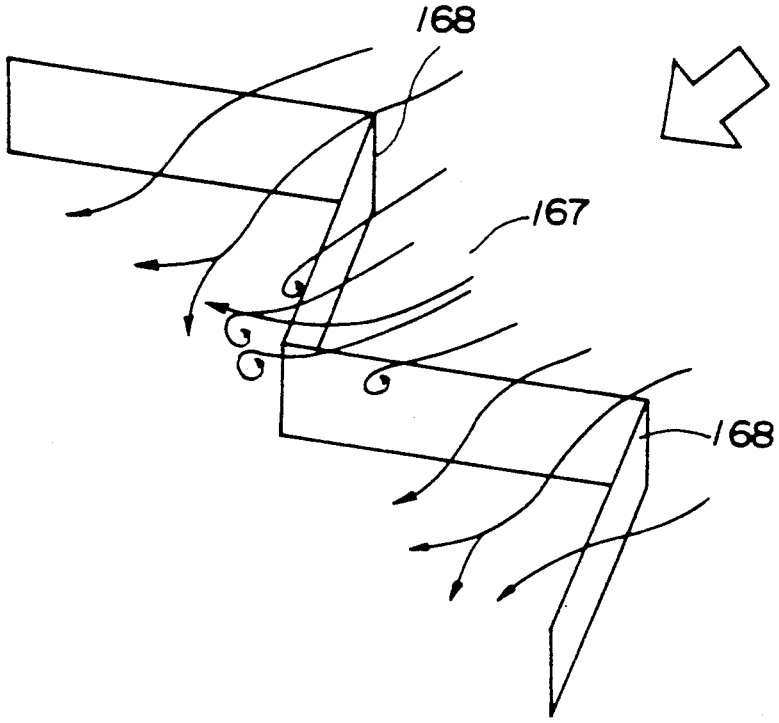
FIG. 22 (PRIOR ART)
FIG. 22 is an explanatory view showing the movement of a flow that collides with a conventional W-shape structure.

From a result of this experiment, it is proved that the dual mound structure has an average height of upwelling whirlpool higher than that of the single mound structure when the projected area is in a range of 2~8. Further, FIG. 16 shows a result of comparison of the frequency of the occurrence of upwelling whirlpool between the single mound structure and the dual mound structure for the same projected area. From a result of this experiment, it is proved that a period of the occurrence of upwelling whirlpool is in a range of 10~15 seconds and that a period of the occurrence of upwelling whirlpool tends to be long when the ratio (H/L) of the height H of the structure to its length L is in a range of 4~8. Furthermore, it is proved that since in the dual mound structure the top height of the partition structure 52 is low, the reaching distance of upwelling whirlpool is shortened and hence a period of the occurrence of upwelling whirlpool is shortened. Moreover, in FIG. 17, the height of upwelling whirlpool per unit time obtained by dividing the average reaching height of upwelling whirlpool by a period of the occurrence of upwelling whirlpool is shown as an index of the efficiency of generating upwelling whirlpool. From a result of this experiment, it is proved that the efficiency of the occurrence of upwelling whirlpool in the dual mound structure is distinctively high is comparison with the single mound structure.

Although the present invention has been described with reference to the preferred embodiments, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. An upwelling-generating structure, comprising generating means for generating upwelling flows which exchange seawater above an offshore deep sea bed between a deep water zone and a surface water zone at which sunlight is available for photosynthesis and for thrusting upward resources of nutrient salts from the deep water zone to the surface water zone for developing assimilation of solar photosynthesis and breeding of plankton in the surface water zone and, at the same, for enriching an amount of dissolved oxygen in the surface water zone as a result of differences in water pressure and temperature between the deep and surface water zones, said generating means including a pair of substantially conic mound structures each having a slope running in a radial direction from a top to seabed, and a partition structure connecting one of said pair of the conic mound structures with the other, said partition structure being lower in height than said pair of the conic mound structures.

2. The upwelling-generating structure as claimed in claim 1 wherein said partition structure has a substantially triangular vertical section with gentle slopes running from a summit thereof to seabed.

3. The upwelling-generating structure as claimed in claim 1 wherein a height of said partition structure is 0.5 to 0.9 times a height of said conic mound structure.

4. The upwelling-generating structure as claimed in claim 1 wherein a length between said pair of the conic mound structures is 4 to 8 times a height of said conic mound structure.

5. The upwelling-generating structure as claimed in claim 1 wherein said slope runs at an angle of 45°to 20°.

6. The upwelling-generating structure as claimed in claim 1 wherein said partition structure has a slope having a greater angle than that of the conic mound structure relative to the seabed.

* * * * *